US005082187A

United States Patent [19]

Kirchhoff et al.

[11] Patent Number: 5,082,187

[45] Date of Patent: Jan. 21, 1992

[54] VIBRATING SCREEN CRUSHER

[75] Inventors: Bernd Kirchhoff; Hermann Mecklenfeld, both of Ennigerloh, Fed. Rep. of Germany

[73] Assignee: O&K Orenstein & Koppel Aktiengesellschaft, Berlin, Fed. Rep. of Germany

[21] Appl. No.: 474,071

[22] PCT Filed: May 2, 1989

[86] PCT No.: PCT/EP89/00485

§ 371 Date: Jan. 7, 1991

§ 102(e) Date: Jan. 7, 1991

[87] PCT Pub. No.: WO90/00443

PCT Pub. Date: Jan. 25, 1990

[30] Foreign Application Priority Data

Jul. 6, 1988 [DE] Fed. Rep. of Germany ..... 3822801

[51] Int. Cl.[5] ..... B02C 1/00

[52] U.S. Cl. ..... 241/84; 241/94; 241/95; 241/262

[58] Field of Search ..... 241/84.3, 84, 94, 95, 241/262, 263, 266, 84.4, 88.4, DIG. 17

[56] References Cited

U.S. PATENT DOCUMENTS

| | | | |
|---|---|---|---|
| 139,173 | 5/1873 | McNeir et al. | 241/84.4 |
| 353,857 | 12/1886 | Hobart | 241/95 X |
| 1,584,721 | 5/1926 | Bland | 241/94 X |
| 2,208,165 | 7/1940 | Sheahan | 241/DIG. 17 X |
| 3,823,881 | 7/1974 | Grob | 241/94 X |
| 4,580,732 | 4/1986 | Mantell | 241/94 X |

FOREIGN PATENT DOCUMENTS

| | | | |
|---|---|---|---|
| 650461 | 9/1937 | Fed. Rep. of Germany . | |
| 1167163 | 4/1964 | Fed. Rep. of Germany . | |
| 1223235 | 8/1966 | Fed. Rep. of Germany . | |
| 3546209 | 7/1987 | Fed. Rep. of Germany . | |
| 342513 | 9/1904 | France . | |
| 6355 | 10/1906 | France . | |
| 436073 | 3/1912 | France . | |
| 935025 | 6/1982 | U.S.S.R. | 241/94 |

*Primary Examiner*—Mark Rosenbaum
*Attorney, Agent, or Firm*—Spencer & Frank

[57] ABSTRACT

In a device for crushing materials, in particular soft stone, a plurality of grates with breaking elements are arranged below a bunker containing the feedstock. At least one of said grates is translationally mobile in the horizontal direction with respect to the other, which facilitates crushing of the feedstock between the vibrating breaker elements and the stationary breaking elements.

13 Claims, 1 Drawing Sheet

VIBRATING SCREEN CRUSHER

BACKGROUND OF THE INVENTION

A device for comminuting, in particular, softer materials such as, coal or the like, the device including at least two vertically spaced, superposed grates disposed in the outlet region of a bunker and equipped with crushing elements of which at least one grate is stationary and at least one further grate is movable translatorily in the horizontal direction relative to the stationary grate.

DE-B 1,167,163 (German Auslegeschrift/laid-open application) discloses a vibrating screen crusher whose vibrating box is equipped with a striking grate at the bottom and is covered at the top, at least in part, by an impact plate. The material passes through this vibrating box in the longitudinal direction and the box is caused to vibrate in the vertical plane by means of two crankshafts equipped with counterbalancing means. The crankshafts are disposed underneath the vibrating box. The impact plate as well as the striking grate are provided with facing crushing teeth. At the vibrating box, in the region of the last third of the impact plate, breaker hammers are pivotally mounted at pivot arms. By way of pneumatic springs the pivot arms are supported at the vibrating box.

DE-C 650,461 discloses a comminutor for coke, coal, and similar substances that includes a crushing machine equipped with picks and a vibratory table carried by longitudinal rods on which the material to be comminuted moves along the vibratory table is being caused to move in a way that produces shaking jolts of a magnitude that corresponds throughout to the size of the pieces brought underneath the various groups of picks.

The drawbacks of these two devices are essentially that the masses to be handled may produce damage to the grates and to the peripheral components due to the superposition of vibrations. In both cases, the passage of the comminuted material is essentially horizontal with no high throughputs being possible due to the materials to be processed.

Additionally, DE-B 1,223,235 discloses a breaker grate for the discharge of a reaction furnace, wherein the grate is formed of a fixed grate composed of parallel grate rods having sharp-edged raised portions and of a movable grate. The movable grate is formed by a frame which includes transverse connecting rods disposed between the raised portions of the fixed grate rods and equipped with breaker heads that cooperate with the grate rods.

The drawbacks of this prior art devic. are essentially that in this arrangement, certain size categories can no longer be drawn in and broken up but roll along only on the edges of the breaker heads insofar as the dimensions of the grain are larger than the amount of lateral shift of the grate. Since the grains are generally not pre-sorted before they are charged onto the grate, the danger exists here of overloading the system since larger chunks clog the intake region. The efficiency of such a system can thus be considered to be relatively low.

SUMMARY OF THE INVENTION

Based on DE-B 1,223,235, it is the object of the invention to improve an apparatus of the above-outlined type to the extent that the highest possible throughput is realized with a simple structural configuration.

This is accomplished by the invention by the combination of the following features:

the upper grate facing the bunker is translatorily movable relative to the grate or grates disposed therebelow, with the crushing elements of the upper grate having their tips oriented downwardly;

the crushing elements of the upper grate as well as those of the grate immediately therebelow have an approximately triangular cross section, with the crushing elements of the stationary grate having their tips oriented downwardly;

the tips of the crushing elements of the movable grate extend into the free space of the crushing elements of the stationary grate disposed therebelow, with the horizontal thrust of the movable grate being selected so that no contact takes place between the individual crushing elements.

Appropriate modifications of the subject matter of the invention are defined in the dependent claims.

In this manner, a structurally simple configuration of the apparatus is realized, with the materials being comminuted and passing through faster due to their vertical passage. Compared to the prior art, significantly fewer components are employed so that a substantially less expensive apparatus can be created. The apparatus is to be employed particularly for the comminution of soft rock, such as coal.

Preferably, at least two spaced superposed grates are provided in the outlet region of the bunker, at least one of which is stationary, with at least one further grate being movable translatorily relative to the stationary grate. The translatorily movable grate is disposed directly in the region of the bunker outlet and the stationary grate or grates are disposed below it. With this measure it is ensured that no clogging can occur in the bunker outlet region since a relative movement always takes place there. The material to be comminuted is always moved horizontally and is comminuted by the crushing elements in their mutually offset arrangement and by the stationary as well as the movable grates. Chunks having a smaller grain size drop through the spaced crushing elements without problems so that, in principle, only materials having an excess grain size need be comminuted.

The movable grate is preferably held within a frame that is driven by rocker bars, with the rocker bars being connected with a drive which converts the rotational motion into translational motion. The drive is disposed outside of the bunker, approximately in the same horizontal plane as the grate and the frame accommodating the grate. With this arrangement the system is substantially free of vibrations. That is, by arranging the drive substantially coplanar with the frame and grate, vibratory movements are substantially transmitted into the grate, and not to other parts of the system such as the bunker and the conveyor.

Below the grates there is provided a conveying device, for example a conveyor belt, a plate conveyor, or the like, to transport away the crushed material.

Preferred fields for use of the subject matter of the invention are mines, stone quarries, and coal pits.

BRIEF DESCRIPTION OF THE DRAWINGS

One embodiment of the invention is illustrated in the drawing figures and will be described below.

DESCRIPTION OF THE PREFERRED EMBODIMENT

Figure 1:
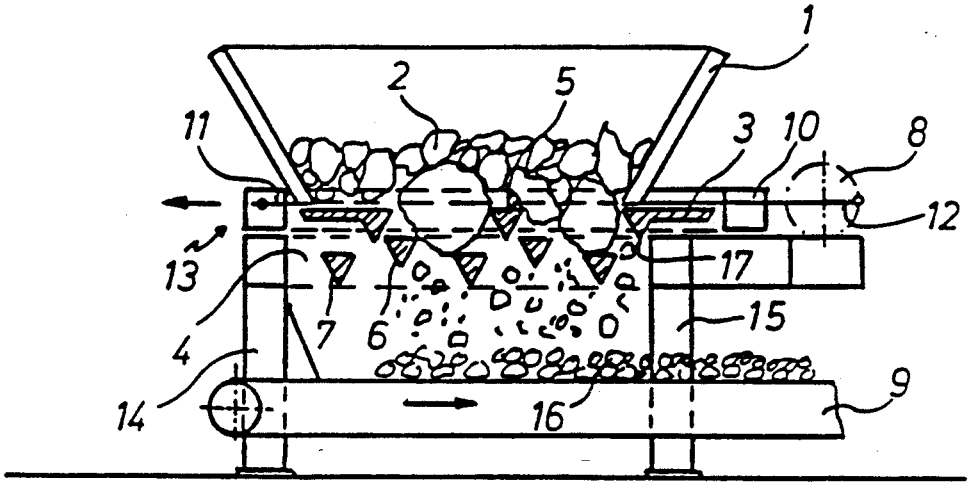
FIGS. 1 to 3 show a preferred embodiment of the invention for comminuting soft rock, including grates which move relative to one another, in various operating positions.
Figure 2:
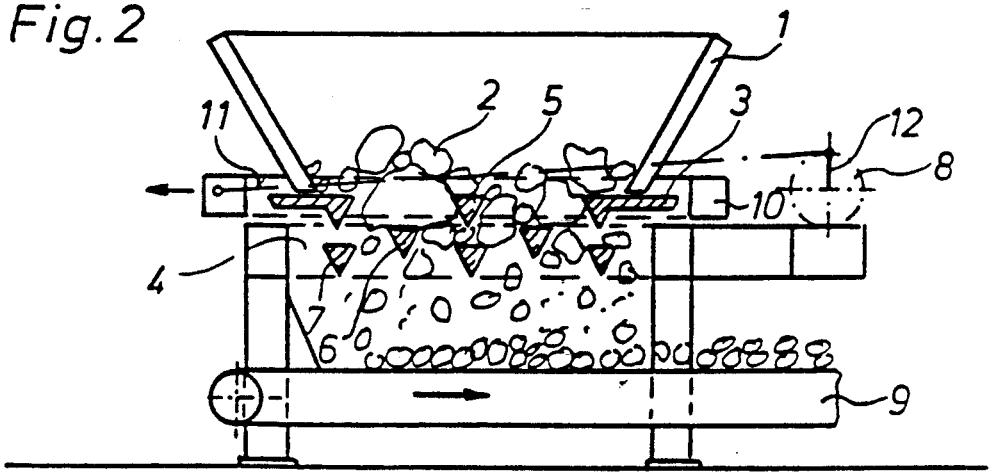
Figure 3:
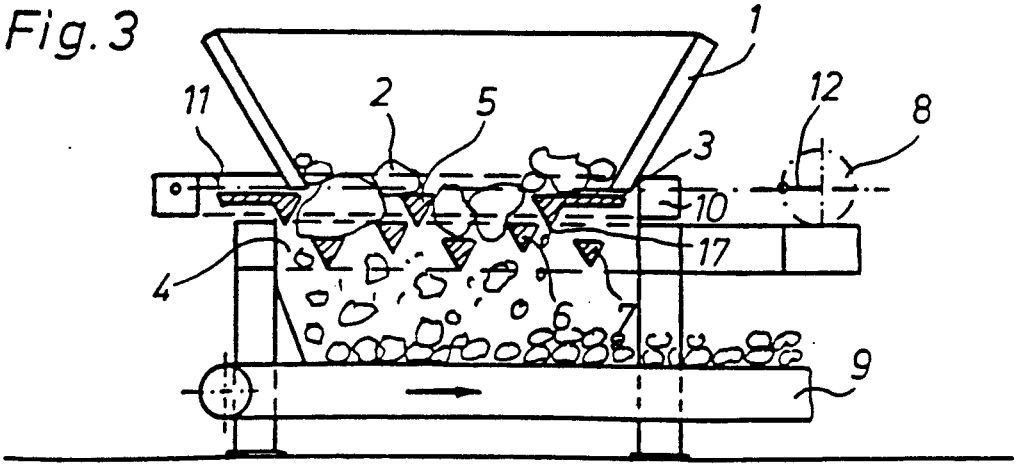

FIGS. 1 to 3 show the apparatus according to the invention in various operating positions. The apparatus is composed of the following components: a bunker 1 for receiving the material 2 to be comminuted, two grates 3, 4 which are equipped with several crushing elements 5, 6, 7 having substantially triangular cross sections and offset from one another in the vertical and horizontal directions, with tips 17 of grate 4 being provided only to guide the material (gap width), and a drive 8 as well as a conveyor belt 9. Grate 3 is held within a frame 10 which, in turn, is hinged to rocker bars 11. Rocker bars 11 are articulated to a crank 12 of drive 8 and, to an opposite end 13 of frame 10. Grate 4 is held stationary within receiving elements 14, 15 to which conveyor belt 9 is also articulated. Comminuted material 16 drops under its own weight onto conveyor belt 9 and is transported away for further use. The tips 17 of the crushing elements 5 of the translatorily moved grate 3 are congruent with the crushing elements 6 of grate 4. Grates 3 and 4 are structurally designed so that, during the translational movement of grate 3, no contact can take place between crushing elements 5 and 6.

FIG. 1 shows the translatorily movable grate 3 in its right-hand starting position, FIG. 2 shows movable grate 3 in its middle position, and FIG. 3 shows grate 3 in its extreme left operating position.

We claim:

1. A device for comminuting material comprising:

a bunker having an outlet;

a stationary grate disposed adjacent said outlet;

a movable grate disposed between said outlet and said stationary grate, said movable grate being translatable relative to said stationary grate;

a plurality of crushing elements having substantially triangular cross sections being disposed on each said stationary and movable grates, each said crushing element having a substantially downwardly oriented tip, a free space being defined between adjacent ones of said crushing elements disposed on said stationary grate, each said tip of said crushing elements disposed on said movable grate extending into one of said free spaces, and each said crushing element being free of contact with the other said crushing elements when said movable grate is translated relative to said stationary grate.

2. A device as defined in claim 1, wherein said crushing elements disposed on said stationary grate are horizontally offset relative to each other.

3. A device as defined in claim 2, wherein said crushing elements disposed on said stationary grate are vertically offset relative to each other.

4. A device as defined in claim 1, wherein said crushing elements disposed on said stationary grate are vertically offset relative to each other.

5. A device as defined in claim 4, further comprising a frame holding said movable grate, and a drivable rocker bar attached to said frame.

6. A device according to claim 5, further comprising a drive means attached to said rocker bar for converting rotational motion into translational motion.

7. A device as defined in claim 6, wherein said drive means is disposed substantially coplanar with said frame and movable grate.

8. A device as defined in claim 7, further comprising a conveyor means disposed below said stationary grate.

9. A device as defined in claim 1, further comprising a frame holding said movable grate, and a drive means disposed substantially coplanar with said frame and movable grate.

10. A device as defined in claim 1, further comprising a frame holding said movable grate, and a drivable rocker bar attached to said frame.

11. A device as defined in claim 10, further comprising a drive means attached to said rocker bar for converting rotational motion into translational motion.

12. A device as defined in claim 11, wherein said drive means is disposed substantially coplanar with said frame and movable grate.

13. A device as defined in claim 12, further comprising a conveyor means disposed below said stationary grate.

* * * * *